US005520572A

United States Patent [19]

Opel et al.

[11] Patent Number: 5,520,572

[45] Date of Patent: May 28, 1996

[54] APPARATUS FOR PRODUCING AND BLASTING SUBLIMABLE GRANULES ON DEMAND

[75] Inventors: Alan E. Opel, Monrovia; Philip Spivak, Toluca Lake; Oleg Zadorozhny, North Hollywood, all of Calif.

[73] Assignee: Alpheus Cleaning Technologies Corp., Rancho Cucamonga, Calif.

[21] Appl. No.: 270,130

[22] Filed: Jul. 1, 1994

[51] Int. Cl.[6] ..... B24C 7/00; B24C 9/00

[52] U.S. Cl. ..... 451/99; 241/92; 451/75

[58] Field of Search ..... 451/39, 40, 2, 451/99, 75; 241/19, 92

[56] References Cited

U.S. PATENT DOCUMENTS

| | | | |
|---|---|---|---|
| 1,032,777 | 7/1912 | Sauer | 451/99 |
| 1,251,087 | 12/1917 | Mosca | 241/92 |
| 1,972,735 | 9/1934 | Fischer | 241/92 |
| 2,181,000 | 7/1936 | Shively | 241/92 |
| 3,089,775 | 5/1963 | Lindall . | |
| 3,702,519 | 11/1972 | Rice et al. . | |
| 4,038,786 | 8/1977 | Fong . | |
| 4,113,190 | 9/1978 | Fudman | 241/92 |
| 4,389,820 | 6/1982 | Fong et al. . | |
| 4,428,535 | 1/1984 | Venetucci . | |
| 4,707,951 | 11/1987 | Gibot et al. . | |
| 4,744,181 | 5/1988 | Moore et al. . | |
| 4,850,408 | 7/1989 | Carpenter et al. | 241/92 |
| 4,947,592 | 8/1990 | Lloyd et al. . | |
| 4,965,968 | 10/1990 | Kelsall . | |
| 5,071,289 | 12/1991 | Spivak . | |
| 5,097,633 | 3/1992 | Branton et al. | 451/2 |
| 5,148,996 | 9/1992 | Fletcher et al. . | |
| 5,184,427 | 2/1993 | Armstrong . | |
| 5,203,794 | 4/1993 | Stratford et al. . | |
| 5,288,028 | 2/1994 | Spivak et al. . | |

FOREIGN PATENT DOCUMENTS 1397102 6/1975 United Kingdom .

OTHER PUBLICATIONS

Clawson Snow Drift® Electric Ice Shaver Specifications; Clawson Machine Company, Franklin, N.J.; 1 p.; Oct. 15, 1993.

SnoWizard Snoball Machine brochure; SnoWizard Holdings, Inc., New Orleans, LA; 4 pp.; 1988.

*Primary Examiner*—Bruce M. Kisliuk
*Assistant Examiner*—Derris H. Banks
*Attorney, Agent, or Firm*—Sheldon & Mak

[57] ABSTRACT

A granulator and delivery system for sublimable $CO_2$ granules has working edges rotatably supported for defining a cutting surface; a driver for powering the working edges; a feeder for advancing solid $CO_2$ into contact with the working edges, the working edges removing the granules from the solid $CO_2$; a duct having an outlet, the granules being directed from the block to flow from the outlet; an eductor having a material inlet, a gas inlet and an eductor outlet, the material inlet being connected to the outlet; a delivery control valve fluid connected between the gas inlet and a source of high pressure gas; a controller responsive to an external signal for: activating the driver, the feeder and the delivery control valve for delivery of granules from the duct in response to activation of the demand signal; deactivating at least one of the driver and the feeder in response to either deactivation of the demand signal for halting production of the granules or for preventing consumption of all but a predetermined portion of the solid $CO_2$; and reversing the feeder for permitting loading of a fresh quantity of solid $CO_2$ into the granulator in response to a predetermined advance of the feeder, and resuming operation of the granulator once the fresh quantity is loaded. Also disclosed is a method of producing and blasting sublimable dry ice granules.

51 Claims, 1 Drawing Sheet

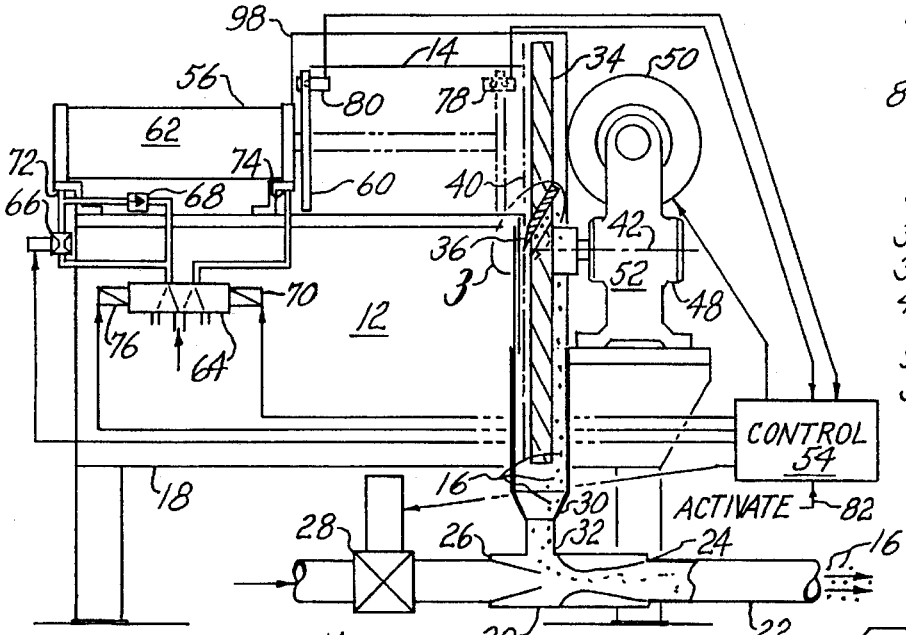
FIG. 1
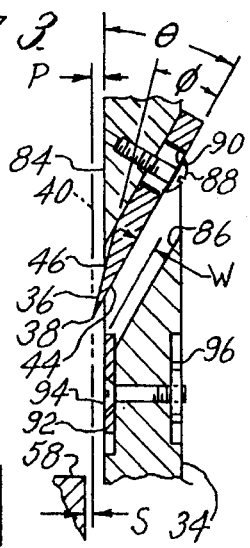
FIG. 3
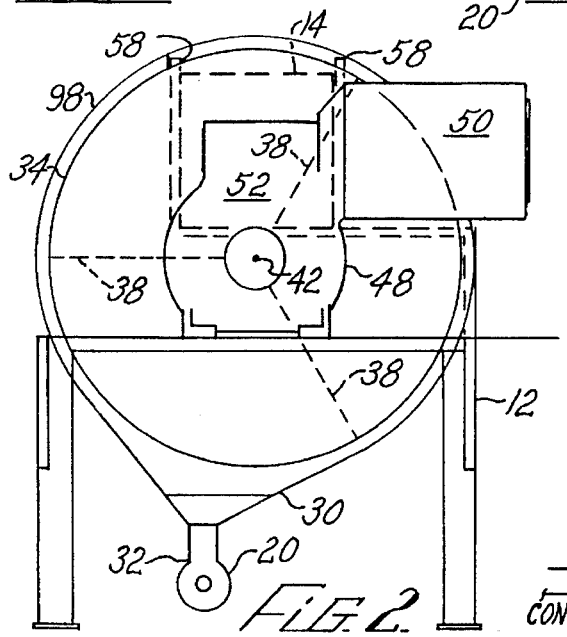
FIG. 2
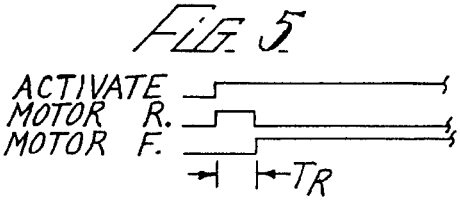
FIG. 5
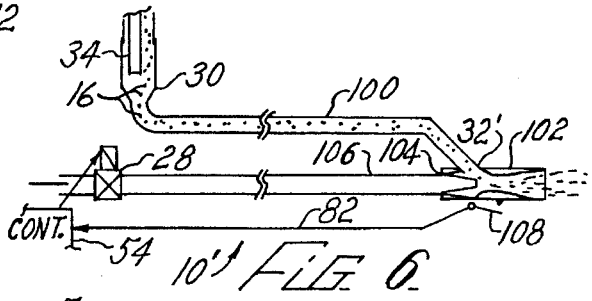
FIG. 6
FIG. 4
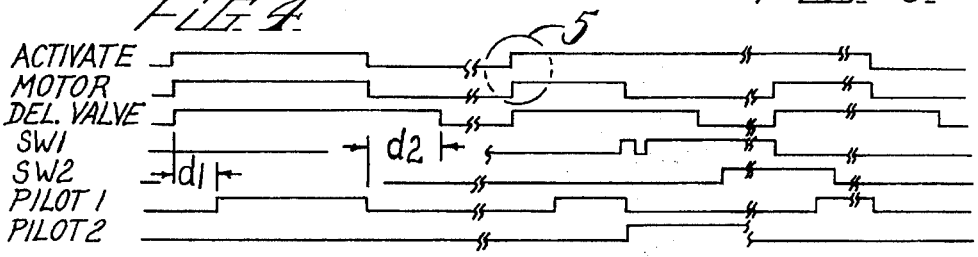

APPARATUS FOR PRODUCING AND BLASTING SUBLIMABLE GRANULES ON DEMAND

BACKGROUND

The present invention relates to abrasive cleaning of a workpiece with high velocity sublimable particles and to production of such particles.

It is commonly known to blast a workpiece with a particulate abrasive that either melts or sublimes at room temperature for cleanly dissipating the abrasive subsequent to its use, thereby avoiding contamination of the workpiece or its environment. The abrasive can be frozen water, typically called "ice", solid carbon dioxide, typically called "dry ice", or combinations comprising one or both of these materials. Dry ice particles are produced in a variety of ways as discussed below, abrasive cleaning most typically employing extruded pellets. Common problems associated with dry ice blasting include the following:

1. The size of the particles greatly affects blasting quality and efficiency, small particles being desired for reaching small features of the workpiece, for avoiding damage to delicate workpiece surfaces, and because small particles are easier to accelerate;
2. It is more difficult to make small particles than big ones;
3. The particles are subject to degradation by subliming, by melting, and by abrasion or pulverization during transport to the workpiece, these mechanisms having increasingly adverse effects as the particle size is reduced; and
4. The particles are subject to clogging in storage and transport to a blasting nozzle.

Early equipment for dry ice blasting employed pelletizers that were developed for the food processing industry, having a high production rate capability. These devices, being disclosed for example in U.S. Pat. Nos. 4,038,786 to Fong and 4,744,181 to Moore, operate cyclicly, with intermediate storage of the pellets, and metering at a desired rate only when blasting. Cyclic pelletizer blasting machines are large, heavy, and complex, requiring a liquid $CO_2$ storage vessel, a cryogenic pump, and insulated supply and return piping, being thus limited in use to fixed facility, non-portable cleaning. Also they are expensive, costing from about $100,000 to $250,000, and power-hungry, requiring from 1.2 to 1.5 horsepower per pound of dry ice per minute. Further, dry ice pellets are difficult to store for even small periods without agglomeration which is detrimental to blasting. Moreover, the pellets are subject to sublimation unless special cooling is provided. The smaller the pellets the more susceptible they are to clumping and/or sublimation.

A later development is continuous pelletizer blasters as disclosed, for example, in U.S. Pat. No. 4,389,820 to Fong et al, wherein liquid $CO_2$ is dispensed and frozen in a snow chamber, the snow falling into a planetary extruder die mechanism where it is compacted into pellets by being forced through radial holes of a ring-shaped die, the length of the pellets being defined by structure that fractures the material by partially blocking the exit paths from the die. The pellets are produced as needed on a real-time basis, with metering by adjusting the rate of pelletizing, for significant savings in the size and weight of the machines. The continuous pelletizer blasters of the prior art require intensively engineered and expensive pelletizers, the overall cost being in the same range as the cyclic blasters. Also, the dynamic range of production is limited such that typical units having sufficiently low minimum output can adequately feed only a single blast cleaning gun or nozzle. Further, they are as power hungry as the cyclic pelletizers, and the power source must be able to handle the dynamic range of pellet production rates. Moreover, portability is limited because of a need for a supply line to a liquid $CO_2$ source, together with the other liquid $CO_2$ handling facilities of the cyclic blasters.

More recently there have appeared portable blasters that are filled from a remote source of the pellets, such as are disclosed in U.S. Pat. Nos. 5,071,289 and 5,288,028 to Spivak, and 5,203,794 to Stratford. These machines can be moved easily, being untethered by liquid $CO_2$ lines and they are much smaller and lighter than ones having pelletizers. They are also less expensive, costing approximately $25,000 to $50,000. However, they can be used only where there is access to a supply of pellets, typically in only a few large metropolitan areas. Long continuous or automated operation is not possible in that they must be refilled with pellets every 30 to 180 minutes. Further, they are particularly susceptible to agglomeration and/or sublimation of the pellets. Moreover, they require a metering device that is difficult to provide in that metering should be smooth and variable for different applications, even in the presence of some agglomeration.

Another form of dry ice blasting equipment is snow guns that provide particles of limited mass and hardness, for cleaning delicate surfaces. Such equipment is not capable of aggressive cleaning, and still requires liquid $CO_2$ facilities and fluid additives. A further form of the blasting equipment is granulator blasters, such as disclosed, for example, in U.S. Pat. Nos. 4,707,951 to Gibot and 4,965,968 to Kelsall. These machines typically crush pieces or chunks of dry ice in a batch mode at a relatively high rate, the crushed dry ice being stored in a hopper and metered as required for blasting. The granulator blasters of the prior art are subject to one or more of the following disadvantages:

1. There is no real-time control of flow from the granulator;
2. They are complex and expensive because sifting and/or sizing is required following crushing for promoting flowability;
3. They are further complex, expensive and unreliable in that they require agitators, fluidizers and/or special cooling, insulating, moisture barriers and the like because stored granules are particularly subject agglomeration and sublimation; and
4. Metering of stored granules is particularly difficult in the presence of agglomeration.

Thus there is a need for a particulate formation and blasting system that effectively and reliably produces and delivers uniformly small particulate on demand and without clogging or degradation of the particles.

SUMMARY

The present invention meets this need by providing a granulator blasting apparatus for high speed delivery of sublimable $CO_2$ granules having substantially uniform size, on demand, the granules being conveyed and accelerated directly upon production thereof. In one aspect of the invention, the apparatus includes a base; a blade carrier movably supported relative to the base; a blade member fixably located on the carrier, movement of the carrier defining a cutting surface during movement of the carrier; a driver for powering the carrier; a feeder for receiving and delivering a supply of frozen $CO_2$ and advancing same in a feed path into contact with the blade member, the blade member moving across the feed path and producing the granules from the frozen $CO_2$; a collector duct having a collector outlet, the granules being directed from the feeder to flow from the outlet; and an accelerator for high speed delivery of the particles directly from the collector outlet.

The blade carrier can be rotatably supported on a carrier axis. The cutting surface can be a plane perpendicular to the carrier axis. The blade member can have a first blade surface inclined at an angle θ from the cutting surface, and a second blade surface inclined at an angle ϕ within the angle θ from the cutting surface, the blade surfaces intersecting at the cutting surface. The angle θ can be between approximately 30° and approximately 50°. Preferably the angle θ is approximately 45°, and the angle ϕ is approximately 30° for reliable production of the granules.

The blade member can be supportively mounted to a blade carrier, the blade carrier having a carrier surface facing the cutting surface, the carrier surface being interrupted proximate the first blade surface for forming a slot through the blade carrier for passage of the granules therethrough. Preferably the carrier surface is approximately uniformly spaced a distance P from the cutting surface for preventing passage of ungranulated portions of the frozen $CO_2$ into the collector duct. Preferably the distance P is between approximately 0.02 inch (0.5 mm) and approximately 0.08 inch (2 mm). The slot can have a width W normal to the first blade surface from the carrier surface, the width W being between approximately 0.05 inch (1.25 mm) to approximately 0.15 inch (3.75 mm).

The apparatus can include a plurality of blade members in spaced relationship about the carrier axis and projecting substantially to the cutting surface. The apparatus can include three of the blade members, equally spaced about the carrier axis. There can be substantially no storage of granules in the collector duct. The duct can be configured with substantially no storage volume therein. The duct can be configured for passage of the granules substantially without delay. The frozen $CO_2$ can be formed in blocks, the feeder including a guide for guiding a train of the blocks in the feed path. Preferably at least 90 percent of the granules have a major dimension between approximately 0.015 inch (0.38 mm) and approximately 0.030 inch (0.76 mm) for efficient and uniform treatment of delicate workpiece surfaces.

The apparatus is preferably operable on demand in response to an external signal for use in intermittent treatment of a workpiece. The apparatus can include a controller responsive to the external signal for activating the driver and the feeder for delivery of granules from the collector duct in response to activation of the demand signal; deactivating at least one of the driver and the feeder in response to either deactivation of the demand signal for halting production of the granules or for preventing consumption of all but a predetermined portion of the frozen $CO_2$; and reversing the feeder for permitting loading of a fresh quantity of frozen $CO_2$ into the apparatus in response to a predetermined advance of the feeder, and resuming operation of the apparatus once the fresh quantity is loaded. Preferably the controller is further operative for momentarily reversing the drive in response to the demand signal for overcoming stiction between the blade member and the frozen $CO_2$.

Preferably an initial flow rate of the granules from the collector duct reaches at least 90 percent of a steady state flow rate within 2 seconds following activation of the external signal. Preferably a terminal flow rate of the granules from the collector duct following inactivation of the external signal falls to not more than 5 percent of a steady state flow rate within 1 second of the demand signal inactivation.

The particle accelerator can include an eductor having a material inlet, a gas inlet and an outlet, the collector outlet being connected to the material inlet. The accelerator can further include a delivery control valve fluid connected between the gas inlet and a source of high pressure gas; a delivery conduit connected to the outlet of the eductor for delivery of the particles entrained in the gas to a remote location; and a controller responsive to an external demand signal and operative for activating the driver, the feeder, and the delivery control valve for delivery of granules in response to activation of the demand signal; deactivating at least one of the driver and the feeder in response to deactivation of the demand signal for halting production of the granules; and deactivating the delivery control valve subsequent to the halting production of the granules.

Preferably the controller is further operative for reversing the feeder for permitting loading of a fresh quantity of frozen $CO_2$ into the apparatus in response to a predetermined advance of the feeder, and resuming operation of the apparatus once the fresh quantity is loaded. Preferably the controller is further operative for controllably varying at least one of (a) force applied to the frozen $CO_2$ by the feeder; and (b) operating speed of the carrier for controlling a desired flow rate of the granules from the collector outlet into the accelerator. The flow rate can be controllable by the controller over a range of at least 4 to 1, thereby permitting the apparatus to be used in many applications requiring variable flow, without utilizing intermediate storage of the granules. The controller can be operative for varying the force applied to the frozen $CO_2$ over a range of at least 2 to 1, and varying the operating speed of the carrier over a range of at least 4 to 1 for effecting the variably controllable flow rate.

In another aspect of the invention, an apparatus for producing sublimable dry ice granules includes a feeder for receiving a supply of dry ice, the feeder being movable in a feed path; a rotatable carrier fixedly mounting at least one cutting element facing the feeder and defining a cutter surface extending across the feed path, wherein the supply of dry ice is advanceable in the feed path against the at least one cutting element during rotation of the carrier for abradingly removing dry ice granules of a predetermined maximum size and size distribution suitable for abrasion cleaning of a workpiece from a surface of the supply of dry ice facing the at least one cutting element. The apparatus can further include a collector duct extending from an interface between the at least one cutting element and the surface of the supply of dry ice; a collector duct outlet extending from the duct and sized to provide a continuing flow of granules from the interface; and an accelerator for accelerating the granules flowing from the collector duct outlet for use in abrasive cleaning.

In a further aspect of the invention, a method of producing and blasting sublimable dry ice granules includes the steps of:

(a) providing a rotatable cutter having a cutting plane;

(b) moving a supply of dry ice along a feed path into the cutting plane;

(c) abrading a surface of the supply of dry ice to continually form dry ice granules of a predetermined maximum size and size distribution;

(d) conducting the granules to an exit duct; and (e) accelerating the granules into a high velocity stream for blasting a workpiece.

DRAWINGS

These and other features, aspects, and advantages of the present invention will become better understood with reference to the following description, appended claims, and accompanying drawings, where:

FIG. 1 is a side elevational view of a particulate granulator and delivery system according to the present invention;

FIG. 2 is an end elevational view of the system of FIG. 1;

FIG. 3 is a detail view of a portion of the system of FIG. 1 within region 3 therein;

FIG. 4 is a timing diagram for the system of FIG. 1;

FIG. 5 is a detail view showing an alternative form of the timing diagram of FIG. 4 within region 5 therein; and FIG. 6 is a side elevational view showing an alternative configuration of a collector and delivery portion of the system of FIG. 1.

DESCRIPTION

The present invention is directed to a sublimable particulate granulator and blast delivery system. With reference to FIGS. 1–3 of the drawings, a blasting system 10 includes a granulator 12 that receives a quantity of blocks, nuggets or pellets and the like of frozen $CO_2$, such as one or more blocks 14 as depicted in the drawings, from which granules 16 are delivered on demand as described herein. The system 10 has a base 18 for supporting the granulator 12 and an eductor 20 for accelerating the granules 16 in a gas stream, the particles being carried in a delivery conduit 22 to a blast nozzle (not shown) for further acceleration as described, for example, in U.S. Pat. No. 5,203,794, which is incorporated herein by this reference. As further shown in FIG. 1, the delivery conduit 22 is connected to an outlet 24 of the eductor 20, a source of high pressure gas being connected to a gas inlet 26 of the eductor 20 through a delivery control valve 28.

According to the present invention, an outlet collector 30 of the granulator 12 directly feeds a material inlet 32 of the eductor 20 without intermediate accumulation or storage of the granules 16, thereby enhancing the simplicity and reliability of the system 10, as well as avoiding unwanted degradation of the granules 16. More particularly, the granules 16 are not subject to agglomeration or sublimation during intermediate storage within the system 10 in that there is no such storage. Further, the granules 16 are accelerated by the eductor 20 substantially immediately upon activation of the granulator 12, the granules continuously flowing in a fluid state immediately upon formation thereof. Moreover, special cooling provisions are generally not required in that the block 14 is much less subject to sublimation than the granules 16, the block 14 having a very much smaller total surface area.

The granulator 12 also includes a blade carrier 34 that is movably supported relative to the base 18 and having a plurality of blade members 36 mounted thereon, the blade members 36 having respective edge extremities 38 that generate a cutting surface 40 during movement of the blade carrier 34. In the exemplary configuration of the granulator 12, the blade carrier 34 is rotatably supported on a carrier axis 42, the cutting surface 40 being planar and oriented perpendicular to the carrier axis 42. In an exemplary configuration of the pelletizer 12 there are three of the blade members 36 equally spaced (120 degrees apart) on the carrier 34 as indicated by the corresponding edge extremities 38 in FIG. 2.

As most clearly shown in FIG. 3, the blade members 36 each have a first blade surface 44 that is inclined at an angle θ from the cutting surface 40, and a second blade surface 46 that intersects the first blade surface at the edge extremity 38, the surfaces 44 and 46 intersecting at an angle ϕ within the angle θ, the angles θ and ϕ being acute angles. The angle θ can range from approximately 20° to approximately 40°, being preferably approximately 30° for producing uniformly sized granules 16 over a wide range of blade speeds and cutting forces. When the angle θ is about 30°, a preferred size of the angle ϕ is approximately 20°.

The carrier 34 is driven by a blade driver 48 for rotating the blade members 36 against the block 14 (counterclockwise in FIG. 2 for the orientation of the blade members 36 shown in FIGS. 1 and 3), the blade members also being advanced into the block 14, the driver 48 including a motor 50 and a speed reducer 52 coupled between the motor 50 and the blade carrier 34, the reducer 52 being fixably supported on the base 18. The motor 50 is controllably driven by a controller 54 that also selectively activates the delivery control valve 26 during operation of the granulator 12. The granulator 12 further includes a feeder 56 for advancing the block 14 toward the cutting surface 40 and into contact with the blade members 36, the feeder 56 also being controlled by the controller 54 as described herein.

The feeder 56 includes a guide 58 for guiding and supporting the block 14 against cutting forces associated with the blade members, and a ram 60 for advancing the block 14 toward the cutting surface 40, the ram 60 including an actuator 62. An exemplary configuration of the actuator 62 is implemented as a pneumatic cylinder, being actuated bidirectionally by a four-way actuator valve 64 in a conventional manner, the actuator valve 64 being pneumatically or electrically connected to the controller 54 for control thereby. The ram 60 also includes a metering control valve 66 connected between the actuator valve 64 and the actuator 62 for limiting a rate and/or force of advancement of the block 14 toward the cutting surface 40. More particularly, the metering control valve 66 can be a flow regulating valve for maintaining a desired rate of advancement that is largely independent of the rotational speed of the blade carrier 34. Additionally or alternatively, the metering control valve 66 can include a pressure regulator for maintaining a desired cutting force component against the direction of movement of the ram 60, the cutting force component being largely independent of the speed of the carrier 34. A one-way valve 68 is associated with the control valve 66 for permitting rapid retraction of the ram 60 when it is desired to introduce a fresh block 14 into the feeder 56. Thus when a first pilot coil 70 is activated by the controller 54, the actuator valve 64 establishes a first connection depicted by solid lines in FIG. 1 wherein a fluid pressure source is connected through the actuator valve 64 and the control valve 66 to an advance port 72 of the actuator 62 for movement of the ram 60 toward the cutting surface 40, fluid from a retract port 74 of the actuator 62 is similarly exhausted through the actuator valve 64. When a second pilot coil 76 is activated by the controller 54, a second connection is established in the actuator valve 64 as indicated by dashed lines in FIG. 1, the fluid pressure is directed to the retract port 74, fluid from the advance port being exhausted through the check valve 68, together with the control valve 66, and the actuator valve 64.

The feeder 56 also includes first and second limit switches 78 and 80 that are connected to the controller 54 for interrupting operation of the actuator 62. More particularly, the first limit switch 78 is located for activation upon movement of the ram 60 to a predetermined distance from the cutting surface 40, the controller 54 being responsive to the first limit switch 78 for terminating activation of the first pilot coil 70, thereby preventing further movement of the ram 60 toward the cutting surface 40. Thus the ram 60 is prevented from contacting the blade members 36 and, if desired, the block 14 can be prevented from being reduced to the point of fracture during operation of the granulator 12. Preferably, for reasons subsequently presented, the first limit switch is held inactive by the presence of either the block 14 or the ram 60, being activated when the ram 60 passes toward the cutting surface 40 beyond a predetermined position. Similarly, the second limit switch 80 is activated upon retraction of the ram 60, the controller terminating activation of the second pilot coil 72 when the ram 60 is retracted sufficiently for introducing a fresh block 14 of the solid $CO_2$.

According to the present invention, the controller 54 is responsive to an externally applied activate signal 82 for activating the system 10 on demand as described herein with further reference to FIG. 4. Upon receipt of the activate signal 82, the controller 54 activates the delivery control valve 28, the motor 50, and the first pilot coil 70 for substantially immediate delivery of the granules 16 into the eductor 20 and the delivery conduit 22. If necessary, the first pilot coil 70 is activated after a short first delay $d_1$ following activation of the motor 50, for permitting starting of the motor 50 before there is loading of the blade members 36 by the block 14. The delay $d_1$ can be from approximately 30 ms to approximately 100 ms. Upon removal of the activate signal 82, the controller 54 deactivates the motor 50 and the first pilot coil 70 for terminating operation of the granulator 12, the delivery control valve 28 being deactivated after a second delay $d_2$ for clearing the outlet collector 30 and the eductor 20 of the granules 16. The second delay $d_2$ can be from approximately 0.5 second to approximately 2 seconds.

In the event of sufficient consumption of the block 14 that the first limit switch 78 is activated as described above, the controller 54 terminates activation of the first pilot coil 70 (and the motor 50 as described above) and initiates activation of the second pilot coil 72 for retracting the ram 60. When the ram 60 is retracted, the first limit switch 78 remains activated until the fresh block 14 is in place (such as by reflecting light, the limit switch being responsive to reflected light from either the block 14 or the ram 60) thereby preventing advancement of the actuator 62 during activation of the external signal 82 during reloading of the block 14.

With further reference to FIG. 5, an alternative configuration of the controller 54 is implemented for bidirectional control of the motor 50, the motor 50 being momentarily driven in reverse during a third delay $d_3$ upon activation of the activate signal 82 for overcoming stiction between the block 14 or other frozen $CO_2$ in the feeder 56 and one or more of the blade members 36, such as in the event of local welding or imbedding of the blade member 36 into the block 14. The delay $d_3$ can be for but a portion of the delay $d_1$ for permitting forward motion of the blade members 36 prior to the application of force by the feeder 56. In the drawings, the motor 50 is depicted as an electric motor that is directly electrically controlled by the controller 54, such control as described above being within the skill of those in the art. It will be further understood that the motor 50 can also be an air-driven motor, having associated therewith appropriate counterparts of the actuator valve 64, etc. as described above in connection with the actuator 62.

As further shown in FIG. 3, the blade carrier 34 preferably has a generally smooth carrier surface 84 from which the blade member 36 projects a short distance P to the cutting surface 40, and the guide 58 extends toward the blade carrier 34 in close proximity to the cutting surface 40, being spaced therefrom by a distance S, for preventing passage of large remnants of the block 14 into the outlet collector 30 when the block 14 is nearly consumed by operation of the system 10. The guide 58 can be suitably located with the distance S being from about 0.02 to 0.04 inch (0.5 to 1 mm), preferably approximately 0.030 inch (0.76 mm) for a desired close proximity without likelihood of contact between the blade member 36 and the guide 58.

While it is desired that the distance P be made similarly small, there should be sufficient clearance for free flow of the granules 16 into the outlet collector 30. Accordingly, the blade carrier 34 is formed with slot passages 86 formed therethrough adjacent the first surfaces 44 of the blade members 36 for permitting the granules 16 to pass from the edge extremities 38 upon formation to the opposite side of the blade carrier 34, thus facilitating flow of the granules 16 without degradation thereof into the outlet collector 30. The blade members 36 are also adjustably mounted to the blade carrier 34, being clamped thereto by screw fasteners 88 that extend through slotted openings 90 of the blade members 36, thereby permitting adjustment of the distance P to a short distance that is sufficient to permit a desired maximum total volume of the granules 16 produced in each pass of any of the blade members 36 on the block 14. It will be understood that as the force applied by the ram 60 is increased, each of the blade members 36 advances more and more rapidly into the block 14 at a given rotational speed of the blade carrier 34, until the block 14 comes into interfering contact with the carrier surface 84.

The limiting volume per revolution of the blade carrier 34 is thus directly proportional to the distance P and to the number of blades 36, assuming that the slot passages 86 do not limit the flow. However, it is also desired that the slot passages 86 be not unnecessarily large, for causing any fragments of the block 14 that are not fully granulated to be broken up in passing through the blade carrier 34. Accordingly, each of the slot passages 86 has an adjustable plate member 92 associated therewith for adjustably defining a slot width W of the slot passage 86 between the plate member 92 and the blade member 36, the width W being defined as in a direction normal to the first blade surface 44. In the exemplary configuration shown in FIG. 3, the plate member 92 is secured in a desired position by screw fasteners 94 that engage respective rotationally captive nuts 96. Typically, the slot width W is made approximately equal to the distance P to which the blade members 36 project from the carrier surface 84, from approximately 0.02 to approximately 0.06 inch (0.5 to 1.5 mm). Accordingly, the system 10 in this preferred configuration is capable of semi-continuous operation that is interrupted only for placing fresh counterparts of the block 14 into the feeder 56. Remnants of the nearly consumed block 14 normally do not need to be cleaned out of the feeder 56 when refilling the feeder 56 for the reasons discussed above, and because the blocks 14 or other pieces of frozen $CO_2$ become at least partially bonded by agglomeration, particularly under applied pressure from the ram 60. Preferably, the feeder 56 is capable of holding a number of the blocks 14 in an endwise train for extending the intervals between reloading the blocks 14.

An experimental prototype of the pelletizer 12 has been built and tested, in a configuration having two of the blade members 36, the blade carrier 34 being approximately 7.5 inches (190 mm) in diameter, the motor 50 operating through the speed reducer 52 at a reduction of 20:1, the motor 50 being an air motor Model VA4S, available from Fenner Fluid Power, of Rockford, Ill. The blade members 36 of the experimental prototype have the angle $\phi$ being approximately 30°, supported by the carrier 34 with the angle $\theta$ being approximately 45°. In the prototype configuration, the actuator 62 is implemented as a rodless pneumatic cylinder having a cylinder diameter of 1.25 inches (32 mm), and a stroke of 55 inches (1.4 m). The granulator 12 was tested using blocks 14 measuring 5 inches (127 mm) square by 10 inches (254 mm) long, the blade carrier 34 being operated between approximately 25 and approximately 150 RPM, the actuator 62 being advanced at pressures between 20 and 60 psi (14.1 and 42.2 kg/cm$^2$), at rates between 0.2 and 1.5 inches (5 and 38 mm) per minute.

The granules 16, being cube-like in shape, were measured and determined to range in size from approximately 0.015 to approximately 0.045 inch (0.38 to 1.14 mm) in major dimension. More particularly, 95 percent of the particles were found to be within the indicated size range, the mean maximum dimension being approximately 0.025 inch (0.635 mm). The blade members 36 were found to be generating the granules 16 and up to speed within 0.2 to 0.5 seconds from the moment of activation of the motor 50, the ram 60 also being up to speed within 0.5 second from the moment of activation of the motor 50. Further, the output of granules 16 from the outlet collector 30 reached at least 90 percent of a steady-state volummetric rate within 2 seconds from the moment of activation of the motor 50. Moreover, the output of granules 16 from the outlet collector 30 substantially ceased within 1 second from the time that the motor 50 was deactivated.

Steady state production rates for the granules 16 by the experimental prototype was controlled by varying the speed of the motor 50 and varying the air pressure applied to the actuator 62 (using a manually adjusted pressure regulator), the results being presented in Tables 1 and 2. In Table 1 the distance P was set at 0.025 inch (0.635 mm), the rate of production ranging from 1.56 lb/min to 6.8 lb/min (3.43 to 14.96 kg/min) as the speed was increased from 30 RPM to 120 RPM and the pressure was increased from 30 psi to 40 psi at the actuator 62. In Table 2, the distance P was changed to 0.050 inch (1.27 mm), the rate of production increasing from 3.5 lb/min to 9.0 lb/min (7.7 to 19.8 kg/min) as the speed was increased from 40 to 100 RPM and the pressure was increased from 30 psi to 40 psi. The mechanical force exerted by the ram 60 ranged from 52 lb. (114 kg) of the block 14 at 30 psi air pressure at the actuator 62 to 70 lb. (154 kg) of the block 14 at 40 psi air pressure.

TABLE 1

| Granule Production (lb/min) - P = 0.025 inch | | |
|---|---|---|
| Blade Speed | Cylinder Pressure | |
| RPM | 30 psi | 40 psi |
| 30 | 1.56 | 2.20 |
| 40 | 2.02 | 3.50 |
| 50 | 3.12 | 4.10 |
| 75 | 4.54 | 4.78 |
| 95 | 5.01 | 5.15 |
| 120 | 6.30 | 6.80 |

TABLE 2

| Granule Production (lb/min) - P = 0.050 inch | | |
|---|---|---|
| Blade Speed | Cylinder Pressure | |
| RPM | 30 psi | 40 psi |
| 40 | 3.5 | 3.5 |
| 50 | 5.8 | 6.2 |
| 75 | 6.5 | 6.8 |
| 100 | 7.8 | 9.0 |

The granulator 12 is provided with a removable cover 98 for limiting heat transfer into the block 14 and the granules 16, the cover 98 extending over the guide 58 and the blade carrier 34, and joining the outlet collector 30.

With further reference to FIG. 6, an alternative configuration of the system, designated 10', has the collector 30 fluid-connected by a suction conduit 100 to a material inlet 32' of a nozzle 102, the nozzle 102 also having a blast inlet 104 for a high pressure gas, the blast inlet 104 being fluid-connected by a blast conduit 106 to a counterpart of the delivery control valve 28. A dispenser switch 108 on the nozzle 102 is connected to the controller 54 for generating the activate signal 82.

Although the present invention has been described in considerable detail with reference to certain preferred versions thereof, other versions are possible. For example, the blade members 36 can be configured as graters or spiral milling cutters rather than having the straight edge extremities 38 as shown in the drawings. Also, the feeder 56 can have friction rollers, caterpillar type tracks, or other means for gripping the blocks 14 in place of the ram 60 for permitting new blocks 14 to be loaded during continuous production of the granules 16. In another variation, separate stacks of the blocks 14 can be independently driven by a pair of the feeders 56 for permitting loading of one of the feeders 56 during operation of the other. The actuator 62 can use liquid hydraulic fluid in place of air, and the actuator 62 can incorporate or utilize one or more solid travel stops in place of one or both of the limit switches 78 and 80. The controller 54 can be responsive to air or hydraulic pressure transients for detecting operation of the travel stops. Further, various alternatives for the particle accelerator include an air eductor, a centrifugal wheel, a venturi, and a combination of air lock and venturi. Therefore, the spirit and scope of the appended claims should not necessarily be limited to the description of the preferred versions contained herein.

What is claimed is:

1. Apparatus for producing and blasting sublimable $CO_2$ granules on demand, comprising:

(a) a base;

(b) a carrier movably supported relative to the base;

(c) a working edge fixably located on the carrier, movement of the carrier defining a cutting surface during movement of the carrier;

(d) a driver for powering the carrier;

(e) a feeder for receiving and delivering a supply of solid $CO_2$ and advancing same in a feed path into contact with the working edge, the working edge moving across the feed path and removing granules from the solid $CO_2$;

(f) means for controlling a rate of granulation;

(g) a duct having an outlet, the granules being directed from the working edge to flow from the outlet, there being substantially no storage of granules in the duct;

(h) an accelerator for accelerating the granules, the accelerator being connected to the outlet.

2. The apparatus of claim 1, wherein the carrier is rotatably supported on a carrier axis.

3. The granulator of claim 2, wherein the cutting surface is a plane perpendicular to the carrier axis.

4. The apparatus of claim 2, wherein the working edge has a first blade surface inclined at an angle θ from the cutting surface, and a second blade surface inclined at an angle ϕ within the angle θ from the cutting surface, the blade surfaces intersecting at the cutting surface.

5. The granulator of claim 4, wherein the angle θ is between approximately 30° and approximately 50°.

6. The granulator of claim 4, wherein the angle θ is approximately 45°.

7. The granulator of claim 6, wherein the angle ϕ is approximately 30°.

8. The apparatus of claim 2, wherein the working edge is supportively mounted to a carrier, the carrier having a carrier surface facing the cutting surface, the carrier surface being interrupted proximate the first blade surface for forming a slot through the carrier for passage of the granules therethrough.

9. The apparatus of claim 8, wherein the carrier surface is approximately uniformly spaced a distance P from the cutting surface for preventing passage of ungranulated portions of the solid $CO_2$ into the duct.

10. The apparatus of claim 9, wherein the distance P is between approximately 0.02 inch (0.5 mm) and approximately 0.08 inch (2 mm).

11. The apparatus of claim 8, wherein the slot has a width W normal to the first blade surface from the carrier surface, the width W being between approximately 0.05 inch (1.25 mm) to approximately 0.15 inch (3.75 mm).

12. The apparatus of claim 2, comprising a plurality of blade members in spaced relationship about the carrier axis and projecting substantially to the cutting surface.

13. The apparatus of claim 12, comprising three of the blade members, equally spaced about the carrier axis.

14. The apparatus of claim 1, the duct being configured with substantially no storage volume therein.

15. The apparatus of claim 1, the duct being configured for passage of the granules substantially without delay.

16. The apparatus of claim 1, wherein the solid $CO_2$ is formed in blocks, the feeder including a guide for guiding a train of the blocks in the feed path.

17. The apparatus of claim 1, wherein at least 90 percent of the granules have a major dimension between approximately 0.015 inch (0.38 mm) and approximately 0.045 inch (1.14 mm ).

18. The apparatus of claim 1, wherein the apparatus is operable on demand in response to an external demand signal.

19. The apparatus of claim 18, further comprising a controller responsive to the external signal for:

(i) activating the driver and the feeder for delivery of granules from the duct in response to activation of the demand signal;

(ii) deactivating at least one of the driver and the feeder in response to either deactivation of the demand signal for halting production of the granules or for preventing consumption of all but a predetermined portion of the solid $CO_2$; and (iii) reversing the feeder for permitting loading of a fresh quantity of solid $CO_2$ into the apparatus in response to a predetermined advance of the feeder, and resuming operation of the apparatus once the fresh quantity is loaded.

20. The apparatus of claim 19, wherein the controller is further operative for momentarily reversing the drive in response to the demand signal for overcoming stiction between the working edge and the solid $CO_2$.

21. The apparatus of claim 18, wherein an initial flow rate of the granules from the duct reaches at least 90 percent of a steady state flow rate within 2 seconds following activation of the demand signal.

22. The apparatus of claim 18, wherein a terminal flow rate of the granules from the duct following inactivation of the demand signal falls to not more than 5 percent of a steady state flow rate within 1 second of the demand signal inactivation.

23. The apparatus of claim 1, wherein the accelerator comprises an eductor having a material inlet, a gas inlet and an outlet, the duct outlet being connected to the material inlet.

24. The apparatus of claim 23 wherein the accelerator further comprises:

(a) a delivery control valve fluid connected between the gas inlet and a source of high pressure gas;

(b) a delivery conduit connected to the outlet of the eductor for delivery of the particles entrained in the gas to a remote location; and (c) a controller responsive to an external demand signal, the controller being operative for:

(i) activating the driver, the feeder, and the delivery control valve for delivery of granules in response to activation of the demand signal;

(ii) deactivating at least one of the driver and the feeder in response to deactivation of the demand signal for halting production of the granules; and (iii) deactivating the delivery control valve subsequent to the halting production of the granules.

25. The apparatus of claim 24 wherein the controller is further operative for reversing the feeder for permitting loading of a fresh quantity of solid $CO_2$ into the apparatus in response to a predetermined advance of the feeder, and resuming operation of the apparatus once the fresh quantity is loaded.

26. The apparatus of claim 24, wherein the controller is further operative for momentarily reversing the drive in response to the demand signal for overcoming stiction between the working and the edge $CO_2$.

27. The apparatus of claim 1, wherein the means for controlling is operative for limiting production of granules by controllably varying at least one of:

(a) force applied to the solid $CO_2$ by the feeder; and (b) operating speed of the carrier for controlling a desired flow rate of the granules from the outlet into the accelerator.

28. The apparatus of claim 27, wherein the flow rate is controllable by the controller over a range of at least 4 to 1.

29. The apparatus of claim 27, wherein the controller is operative for varying the force applied to the solid $CO_2$ over a range of at least 2 to 1, and varying the operating speed of the carrier over a range of at least 4 to 1.

30. Apparatus for producing sublimable dry ice granules, comprising:

(a) feeder for receiving a supply of dry ice, the feeder being movable in a feed path;

(b) a rotatable carried fixedly mounting at least one cutting element facing the feeder and defining a cutter surface extending across the feed path; and (c) a controller for driving the feeder and the carrier in response to an external demand signal, wherein the supply of dry ice is advanceable in the feed path against the at least one cutting element during rotation of the carrier for cutting material from the supply, thereby producing dry ice granules of a predetermined maximum size and size distribution suitable for abrasion cleaning of a workpiece from a surface of the supply of dry ice facing the at least one cutting element, the controller being operative for adjusting a rate of production of the granules.

31. The apparatus of claim 30, further including a duct extending from an interface between the at least one cutting element and the surface of the supply of dry ice; a outlet extending from the duct and sized to provide a continuing flow of granules from the interface; and an accelerator for accelerating the granules flowing from the outlet for use in abrasive cleaning.

32. A method of producing and blasting sublimable dry ice granules, comprising the steps of:

(a) providing a movable mechanical working edge;

(b) providing a supply of dry ice;

(c) forcibly uniting the supply of dry ice and the movable working edge to produce dry ice granules of a predetermined size and distribution;

(d) controlling a production rate of the granules;

(e) conducting the granules to an exit duct; and (f) accelerating the granules into a high velocity stream for blasting a workpiece, the method having substantially no intermediate storage of the granules.

33. The method of claim 32, wherein the step of forcibly uniting comprises the further step of moving the working edge in a closed path, the closed path defining a cutting plane.

34. The method of claim 33, Wherein the step of moving the working edge comprises rotating the working edge.

35. The method of claim 33, wherein the step of controlling the rate of granulation comprises, in the step of forcibly uniting, the further step of controlling a velocity of the frozen $CO_2$ along a feed path, the feed path intersecting the cutting plane.

36. The method of claim 35, wherein the step of controlling the rate of granulation further comprises, in the step of moving the working edge, the further step of controlling a rate of movement of the cutter.

37. The method of claim 32, wherein the step of forcibly uniting comprises the further step of moving the supply of dry ice along a feed path.

38. The method of claim 37, wherein the step of controlling the rate of granulation comprises, in the step of forcibly uniting, the further step of controlling a force applied to the solid $CO_2$ in the direction of the feed path.

39. The method of claim 32, wherein the step of controlling the rate of granulation further comprises, in the step of forcibly uniting, the further step of controlling a rate of movement of the working edge relative to the supply.

40. The method of claim 32, wherein the step of controlling the production rate is at a speed that is effective for substantially avoiding conversion of the supply of dry ice into gas and dust.

41. The method of claim 32, wherein the step of forcibly uniting comprises the further step of moving the working edge at a velocity not greater than approximately 60 inches/second relative to the supply of dry ice.

42. The method of claim 32, wherein the step of forcibly uniting comprises the further step of moving the working edge at a velocity not greater than approximately 48 inches/second relative to the supply of dry ice.

43. The apparatus of claim 42, wherein the blade carrier is rotatably supported on a carrier axis, the cutting surface being in a plane perpendicular to the carrier axis.

44. The apparatus of claim 42, wherein the frozen $CO_2$ is formed in blocks, the feeder including a guide for guiding a train of the blocks in the feed path.

45. The apparatus of claim 42, wherein at least 90 percent of the granules have a major dimension between approximately 0.015 inch (0.38 mm) and approximately 0.045 inch (1.14 mm).

46. The apparatus of claim 42, wherein the apparatus is operable on demand in response to an external demand signal, the apparatus further comprising a controller responsive to the external signal for:

(i) activating the driver and the feeder for delivery of granules from the duct in response to activation of the demand signal;

(ii) deactivating at least one of the driver and the feeder in response to either deactivation of the demand signal for halting production of the granules or for preventing consumption of all but a predetermined portion of the frozen $CO_2$; and (iii) reversing the feeder for permitting loading of a fresh quantity of frozen $CO_2$ into the apparatus in response to a predetermined advance of the feeder, and resuming operation of the apparatus once the fresh quantity is loaded.

47. The apparatus of claim 42, wherein the accelerator comprises an eductor having a material inlet, a gas inlet and an outlet, the duct outlet being connected to the material inlet.

48. A particulate apparatus and delivery system for producing sublimable $CO_2$ granules of substantially uniform size, the system comprising:

(a) a base (b) a blade carrier movably supported relative to the base, the blade carrier being rotatably supported on a carrier axis;

(c) a blade member fixably located on the carrier, movement of the carrier defining a cutting surface during movement of the carrier, the blade member having a first blade surface inclined at an angle $\theta$ from the cutting surface, and a second blade surface inclined at an angle $\phi$ within the angle $\theta$ from the cutting surface, the blade surfaces intersecting at the cutting surface, the angle $\theta$ being approximately 45°, and the angle $\phi$ being approximately 30°;

(d) a driver for powering the carrier;

(e) a feeder for receiving and delivering solid $CO_2$ and advancing same in a feed path into contact with the blade member, the blade member moving across the feed path and removing the granules from the solid $CO_2$;

(f) a duct having an outlet, the granules being directed from the feeder to flow from the outlet with substantially no storage of granules in the duct;

(g) an eductor having a material inlet, a gas inlet and an eductor outlet, the material inlet being connected to the outlet;

(h) a delivery control valve fluid connected between the gas inlet and a source of high pressure gas; and (i) a controller responsive to an external signal for:

(i) activating the driver, the feeder and the delivery control valve for delivery of granules from the duct in response to activation of the demand signal, an initial flow rate of the granules from the eductor outlet reaching at least 90 percent of a steady state flow rate within 2 seconds following activation of the external signal;

(ii) deactivating at least one of the driver and the feeder in response to either deactivation of the demand signal for halting production of the granules or preventing consumption of all but a predetermined portion of the solid $CO_2$, a terminal flow rate of the granules from the eductor outlet falling to not more than 5 percent of a steady state flow rate within 1 second upon inactivation of the external signal;

(iii) momentarily reversing the driver in response to the demand signal for overcoming stiction between the blade member and the solid $CO_2$; and (iv) reversing the feeder for permitting loading of a fresh quantity of solid $CO_2$ into the apparatus in response to a predetermined advance of the feeder, and resuming operation of the apparatus once the fresh quantity is loaded.

49. Apparatus for producing and blasting syblimabel $CO_2$ granules on demand, comprising:

(a) a base;

(b) a blade carrier movably supported relative to the base;

(c) a blade member fixably located on the carrier, movement of the carrier defining a cutting surface during movement of the carrier;

(d) a driver for powering the carrier;

(e) a feeder for receiving and delivering a supply of frozen $CO_2$ and advancing same in a feed path into contact with the blade member, the blade member moving across the feed path and cutting material for producing granules from the frozen $CO_2$;

(f) a duct having an outlet and being configured for free and immediate passage of the granules from the feed path, within the duct, and from the duct outlet; and (g) accelerator for accelerating the granules, the accelerator being connected to the duct outlet.

50. The Apparatus of claim 49, wherein the blade member has a first blade surface inclined at an angle $\theta$ from the cutting surface, and a second blade surface inclined at an angle $\phi$ within the angle $\theta$ from the cutting surface, the blade surfaces intersecting at the cutting surface.

51. The apparatus of claim 49, wherein the blade member is supportively mounted to a blade carrier, the blade carrier having a carrier surface facing the cutting surface, the carrier surface being interrupted proximate the first blade surface for forming a slot through the blade carrier for passage of the granules therethrough, the carrier surface being approximately uniformly spaced a distance P from the cutting surface for preventing passage of ungranulated portions of the frozen $CO_2$ into the collector duct, the distance P being between approximately 0.02 inch (0.5 mm) and approximately 0.08 inch (2 mm).

* * * * *